US006257155B1

(12) United States Patent
Greene

(10) Patent No.: US 6,257,155 B1
(45) Date of Patent: Jul. 10, 2001

(54) CURVED BLADE BY-PASS DAMPER WITH FLOW CONTROL

(75) Inventor: Benjamin T. Greene, Enfield, CT (US)

(73) Assignee: Alstom Power N.V. (NL)

( * ) Notice: Subject to any disclaimer, the term of this patent is extended or adjusted under 35 U.S.C. 154(b) by 0 days.

(21) Appl. No.: 09/688,719

(22) Filed: Oct. 16, 2000

(51) Int. Cl.[7] ..... F23J 11/00; F23L 13/00; F23L 11/00

(52) U.S. Cl. ..... 110/163; 110/147; 137/875; 126/285 R

(58) Field of Search ..... 126/285 R; 137/875, 137/876; 110/163, 342, 345, 147, 148; 251/212; 122/479.5

(56) References Cited

U.S. PATENT DOCUMENTS 2,081,307 * 5/1937 Rosenberg ..... 126/292
4,209,037 * 6/1980 Upham ..... 137/527
4,245,569 * 1/1981 Fallon, III ..... 110/215
4,441,653 * 4/1984 Grudich ..... 236/93 R
4,738,226 * 4/1988 Kashiwazaki et al. ..... 122/480
5,943,865 * 9/1999 Cohen ..... 60/653
5,988,115 * 11/1999 Anderson et al. ..... 122/4 D
6,129,335 * 10/2000 Yokogi ..... 251/212
6,146,605 * 11/2000 Spokoyny ..... 423/239.1

* cited by examiner

*Primary Examiner*—Denise L. Ferensic
*Assistant Examiner*—Kenneth B Rinehart
(74) *Attorney, Agent, or Firm*—Russell W. Warnock

(57) ABSTRACT

A damper vane assembly for controlling the flow of flue gas between a flue gas pass of a combustion vessel which generates flue gas and a selective catalytic reactor operable to catalytically treat flue gas in a combustion system is provided. The damper vane assembly includes a first turning vane having a curved extent and a second turning vane with a curved extent. The first turning vane is moveable between a blocking position in which it blocks communication between the combustion vessel and the selective catalytic reactor and a flow guiding position in which the curved extent of the first turning vane guides flue gas from the flue outlet to the selective catalytic reactor. The second turning vane is moveable between a blocking position in which it blocks communication between the selective catalytic reactor and the flue gas outlet and a flow guiding position in which the curved extent of the second turning vane guides flue gas from the selective catalytic reactor to the flue gas outlet.

3 Claims, 7 Drawing Sheets

CURVED BLADE BY-PASS DAMPER WITH FLOW CONTROL

BACKGROUND OF THE INVENTION

This invention relates to steam generation systems of the type which includes a selective catalytic reduction capability for catalytically treating flue gas created by the combustion process and, more particularly, relates to a damper vane assembly for such a system operable to regulate the flow of flue gas to a selective catalytic reduction apparatus (SCR).

The reduction of nitrogen oxides ($NO_x$) emissions from stationary combustion sources, such as fossil fuel-fired power generation systems, has become a critical issue in many nations. As a result, the technology associated with the control of $NO_x$ emissions from fossil fuel-fired power generation systems has matured and expanded significantly. The $NO_x$ emissions reduction processes available for use with fossil fuel-fired power generation systems through $NO_x$ control within the fossil fuel-fired steam generator, such as by means of, for example, overfire air, gas recirculation, reduced-excess-air firing, gas mixing, low-$NO_x$ concentric tangential firing, staged combustion, fluidized-bed firing, etc.; and through post combustion $NO_x$ control effected downstream of the fossil fuel-fired steam generator primarily through the use of selective catalytic reduction (SCR) equipment, provide several alternatives for meeting strict nitrogen-oxide emission levels. Depending on the $NO_x$ emission level required, an optimum $NO_x$ reduction system may result in the integration of several of the above techniques in the overall fossil fuel-fired power generation system.

An example of a fossil fuel-fired power generation systems having $NO_x$ reduction equipment incorporated therewithin is disclosed in U.S. Pat. No. 4,220,633, which issued on Sep. 2, 1980 and which is entitled "Filter House and Method for Simultaneously Removing $NO_x$ and Particulate Matter from a Gas Stream." In accordance with the teachings of U.S. Pat. No. 4,220,633, there is provided a vapor generator and a filter house, the latter being disposed between the vapor generator and an air preheater. An ammonia storage tank is positioned to introduce ammonia via an ammonia distribution grid into the flue gas inlet conduit through which flue gas is transported from the vapor generator to the filter house. The filter house is designed to be operative for removing or cleansing $NO_x$ emissions from the flue gas stream transported thereto during the passage thereof through the filter house while simultaneously filtering out entrained particulate matter from the same flue gas stream. The selective catalytic reduction process was originally developed for those applications where strict $NO_x$ emission requirements dictate the use of post-combustion $NO_x$ reduction techniques. The selective catalytic reduction process was initially applied to natural gas-fired power generation systems, then to low and high sulfur oil-fired power generation systems, and finally to coal-fired power generation systems.

The selective catalytic reduction system uses a catalyst and a reductant, e.g., ammonia gas, i.e., $NH_3$, to dissociate $NO_x$ to nitrogen gas and water vapor. The catalytic-reactor chamber is typically located between the economizer outlet of the fossil fuel-fired steam generator and the flue-gas inlet of the air preheater of the fossil fuel-fired power generation system. This location is typical for fossil fuel-fired power generation systems with selective catalytic reduction system operating temperatures of 575° F. to 750° F., i.e., 300° C. to 400° C.

Upstream of the selective catalytic reduction chamber are the ammonia injection pipes, nozzles, and mixing grid. Through orifice openings in the ammonia injection nozzles, a diluted mixture of ammonia gas in air is dispersed into the flue-gas stream. After the mixture diffuses, it is further distributed in the gas stream by a grid of carbon steel piping in the flue-gas duct. The ammonia/flue-gas mixture then enters the reactor where the catalytic reaction is completed.

The flue gas which is treated in a selective catalytic reduction arrangement such as an SCR is typically flowed to the SCR via dedicated duct work which is branched from other duct work in the back pass region of the fossil fuel fired power generation system. It can be advantageous to provide a flue gas flow arrangement which permits regulating the flow of flue gas such that the SCR can be isolated from the flue gas during certain times such as, for example, when it is desired to place the SCR out of service or to perform maintenance on the SCR. It is known to provide a combination of dampers operable within the flue gas duct work to effect such an isolation of the SCR. Dampers for selective diversion of flue gas are known such as, for example, the damper disclosed in U.S. Pat. No. 3,897,773 which issued on Aug. 5, 1975 and is entitled "Damper". This reference discloses a blade damper operable to isolate a heat exchanger so that flue gases do not flow thereto but, instead, flow to a bypass stack.

Moreover, insofar as the optimization of the operating efficiency of a fossil fuel-fired power generation system that incorporates selective catalytic reduction is concerned, such optimization of the operating efficiency thereof must be attained while yet ensuring that the operating temperature requirements of the SCR are satisfied. In this regard, as has been noted herein previously, in order to realize the performance desired therefrom the SCR must be located within the fossil fuel-fired power generation system such that the operating temperature to which the SCR is subjected is between 575° F. and 750° F. Not only must this temperature range be maintained for the SCR when the fossil fuel-fired power generation is being operated at full load, but also must be maintained when the fossil fuel-fired power generation system is being operated other than at full load—in other words, operation at a partial load. In order to maximize the flexibility of controlling the gas temperature leaving the fossil fuel-fired power generation system, a flue gas bypass around a portion of the heat transfer surface thereof can be utilized. Thus, in the event of an operation at partial load, it may be desirable to regulate the flow of flue gas to the SCR through such a bypass duct and such routing of the flue gas through the bypass duct can be aided by an appropriate damper arrangement.

In the case of fossil fuel-fired power generation systems that incorporate an SCR therewithin, there is a need for a capability to regulate the flow of flue gas relative to the SCR to permit isolation of the SCR from flue gas during certain times such as out of service times and maintenance times. Also, there is a need in connection with the optimization of the operating efficiency of such a fossil fuel-fired power generation system to ensure adequate volumes of flue gas can be flowed to the SCR via a bypass duct during operation at a low load.

SUMMARY OF THE INVENTION

It is, therefore, an object of the present invention to provide a new and improved apparatus in the form of a damper vane assembly for a steam generator such as, for example, a fossil fuel-fired power generation system, in order to thereby be able to attain optimization of the operating efficiency of such a steam generator.

It is another object of the present invention to provide such an apparatus in the form of a damper vane assembly for a fossil fuel-fired power generation system in order to thereby be able to attain optimization of the operating efficiency of such a fossil fuel-fired power generation system when such a fossil fuel-fired power generation system incorporates selective catalytic reduction equipment, i.e., an SCR.

A still another object of the present invention is to provide such an apparatus in the form of a damper vane assembly for a fossil fuel-fired power generation system in order to thereby be able to attain optimization of the operating efficiency of such a fossil fuel-fired power generation system when such a fossil fuel-fired power generation system is being operated at full load.

A further object of the present invention is to provide such an apparatus in the form of a damper vane assembly for a fossil fuel-fired power generation system in order to thereby be able to attain optimization of the operating efficiency of such a fossil fuel-fired power generation system when such a fossil fuel-fired power generation system is being operated at other than full load.

Yet an object of the present invention is to provide such an apparatus in the form of a damper vane assembly for a fossil fuel-fired power generation system in order to thereby be able to attain optimization of the operating efficiency of such a fossil fuel-fired power generation system when such a fossil fuel-fired power generation system is being employed in a new application.

Yet a further object of the present invention is to provide such an apparatus in the form of a damper vane assembly for a fossil fuel-fired power generation system in order to thereby be able to attain optimization of the operating efficiency of such a fossil fuel-fired power generation system when such a fossil fuel-fired power generation system is employed in a retrofit application.

Yet another object of the present invention is to provide such an apparatus in the form of a damper vane assembly for a fossil fuel-fired power generation system in order to thereby be able to attain optimization of the operating efficiency of such a fossil fuel-fired power generation system, which is relatively easy to install and operate, while yet being relatively inexpensive to provide.

Accordingly, the present invention provides a damper vane assembly for controlling the flow of flue gas between a flue gas pass of a combustion vessel which generates flue gas and a selective catalytic reactor operable to catalytically treat flue gas in a combustion system. The damper vane assembly includes a first turning vane having a curved extent and a second turning vane with a curved extent. The first turning vane is moveable between a blocking position in which it blocks communication between the combustion vessel and the selective catalytic reactor and a flow guiding position in which the curved extent of the first turning vane guides flue gas from the flue outlet to the selective catalytic reactor. The second turning vane is moveable between a blocking position in which it blocks communication between the selective catalytic reactor and the flue gas outlet and a flow guiding position in which the curved extent of the second turning vane guides flue gas from the selective catalytic reactor to the flue gas outlet.

According to further aspects of the damper vane assembly of the present invention, the first turning vane is mounted relative to the flue gas pass and the inlet passage and is dimensioned relative to the flue gas pass and the inlet passage such that, in the blocking position of the first turning vane, the first longitudinal edge and the second longitudinal edge—which together comprise a pair of opposed edges of the first turning vane—are in substantially sealing engagement with a surface of the inlet passage to substantially block the flow of flue gas therepast. Additionally, the first turning vane is mounted relative to the flue gas pass and the inlet passage and is dimensioned relative to the flue gas pass and the inlet passage such that, in the flow guiding position of the first turning vane, the one opposed edge—namely, the second longitudinal edge—is in substantially sealing engagement with a surface of the flue gas pass and the other opposed edge—namely, the first longitudinal edge—is in substantially sealing engagement with the inlet passage so as guide flue gas from the flue gas pass into the inlet passage. Moreover, it can be seen that the second ting vane is mounted relative to the flue gas pass and the outlet passage and is dimensioned relative to the flue gas pass and the outlet passage such that, in the blocking position of the second turning vane, the first longitudinal edge and the second longitudinal edge—which together comprise a pair of opposed edges of the second turning vane—are in substantially sealing engagement with the outlet passage to substantially block the flow of flue gas therepast. Also, the second turning vane is mounted relative to the flue gas pass and the outlet passage and is dimensioned relative to the flue gas pass and the outlet passage such that, and, in the flow guiding position of the second turning vane, the one opposed edge—namely, the second longitudinal edge —is in substantially sealing engagement with a surface of the flue gas pass and the other opposed edge—namely, the first longitudinal edge—is in substantially sealing engagement with the outlet passage so as guide flue gas from the outlet passage into the flue gas pass.

DESCRIPTION OF THE PREFERRED EMBODIMENT

Figure 1:
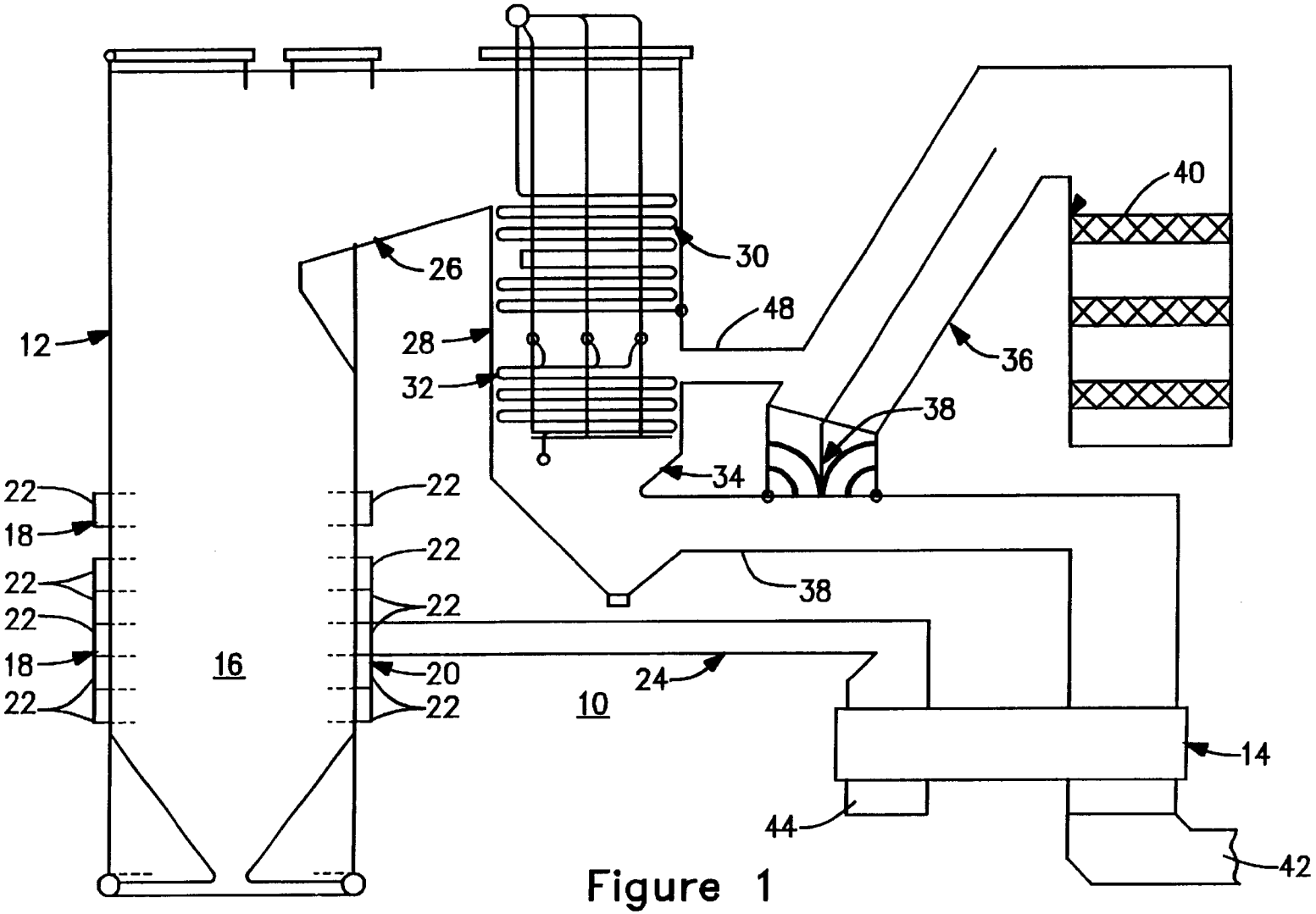
FIG. 1 is a front elevation view of a fossil fuel-fired power generation system having a selective catalytic reactor (SCR) capability and having one embodiment of the damper vane assembly of the present invention.

Referring now to the drawing, and more particularly to FIG. 1 thereof, there is depicted therein one embodiment of a fossil fuel-fired power generation system, generally designated by the reference numeral 10, having a selective catalytic reactor capability. In accordance with the illustration thereof in FIG. 1, the fossil fuel-fired power generation system 10 includes a fossil fuel-fired steam generator, generally designated by the reference numeral 12, and an air preheater, generally designated therein by the reference numeral 14.

The fossil fuel-fired steam generator 12 includes a burner region, 16 within which the combustion of fossil fuel and air, in a manner well-known to those skilled in this art, is initiated. To this end, the fossil fuel-fired steam generator 12 is provided with a firing system, generally designated by the reference numeral 18, which by way of exemplification and not limitation, may take the form of that which comprises the subject matter of U.S. Pat. No. 5,020,454, which issued on Jun. 9,1991.

The firing system 18 includes a housing preferably in the form of a windbox denoted generally in FIG. 1 by the reference numeral 20. The windbox 20 in a manner well-known to those skilled in this art is supported by conventional support means (not shown) in the burner region 16 of the fossil fuel-fired steam generator 12 such that the longitudinal axis of the windbox 20 extends substantially in parallel relation to the longitudinal axis of the fossil fuel-fired steam generator 12. Further, as denoted schematically at 22 in FIG. 1 the windbox 20 embodies in known fashion a plurality of compartments. In conventional fashion some of the compartments 22 are designed to function as fuel compartments from which fossil fuel is injected into the burner region 16 of the fossil fuel-fired steam generator 12, while others of the compartments 22 are designed to function as air compartments from which air is injected into the burner region 16 of the fossil fuel-fired steam generator 12. The fossil fuel, which is injected into the burner region 16 of the fossil fuel-fired steam generator 12 from the fuel compartments 22, is supplied to the windbox 20 by a fuel supply means not shown in the interest of maintaining clarity of illustration in the drawing. Similarly, at least some of the air, which is injected into the burner region 16 of the fossil fuel-fired steam generator 12 for purposes of effecting the combustion therewithin of the fuel that is injected thereinto, is supplied to the windbox 20 from the air preheater 14 through the duct, which is schematically depicted in FIG. 1 of the drawing wherein the duct is denoted generally by the reference numeral 24.

Continuing with the description of the fossil fuel-fired steam generator 12, which is illustrated in FIG. 1 of the drawing, it is within the burner region 16 of the fossil fuel-fired steam generator 12, as has been mentioned previously herein, that the combustion of the fossil fuel and air, which is injected thereinto, is initiated. The hot gases that are produced from this combustion of the fossil fuel and air rise upwardly in the fossil fuel-fired steam generator 12. During the upwardly movement thereof in the fossil fuel-fired steam generator 12, the hot gases in a manner well-known to those skilled in this art give up heat to the fluid flowing through the tubes (not shown in the interest of maintaining clarity of illustration in the drawing) that in conventional fashion line all four of the walls of the fossil fuel-fired steam generator 12. Then, the hot gases flow through the horizontal pass, generally designated by the reference numeral 26, of the fossil fuel-fired steam generator 12, which in turn leads to the rear gas pass, generally designated by the reference numeral 28, of the fossil fuel-fired steam generator 12. Although not shown in FIG. 1 of the drawing in the interest of maintaining clarity of illustration in the drawing, it is to be understood that the horizontal pass 26 would commonly have suitably provided therewithin some form of heat transfer surface. Similarly, heat transfer surface, as illustrated at 30 and 32 in FIG. 1 of the drawing, may be provided within the gas pass 28 in the form of superheater surface and economizer surface, respectively. During the passage thereof through the rear gas pass 28 of the fossil fuel-fired steam generator 12, the hot gases give up heat to the fluid flowing through the tubes depicted in FIG. 1 of which the superheater 30 is comprised as well as to the fluid flowing through the tubes also depicted in FIG. 1 of which the economizer 32 is comprised.

Upon exiting from the rear gas pass 28 of the fossil fuel-fired steam generator 12 the hot gases are conveyed to the air preheater 14. To this end, the fossil fuel-fired steam generator 12 has a flue gas outlet 34 which is located downstream of the economizer 32 relative to the flue flow and which is communicated with both an Branch ductwork 36 and the air preheater 14. A vane damper assembly 38 is mounted relative to the Branch ductwork 36 for cooperating therewith to selectively guide flue gas solely to the air preheater 14, solely to a selective catalytic reactor, hereinafter designated as the SCR 40, or proportionally to both the air preheater 14 and the SCR 40.

The hot gases that are conveyed to the SCR 40 are catalytically treated thereat and then subsequently conveyed by the branch ductwork 36 to the air preheater 14. Thus, all of the hot gases exiting the exit end 34 of rear gas pass 28, whether catalytically treated or not, are ultimately conveyed to the air preheater 14 for flow through the air preheater 14 and exit therefrom, through stack exit ductwork 42, to an exhaust stack (not shown in the interest of maintaining clarity of illustration in the drawings). In the course of flowing through the air preheater 14, the hot gases give up heat to the air, which enters the air preheater 14 through air intake ductwork 44 in FIG. 1. After being heated within the air preheater 14, this air that entered the air preheater 14 through the air intake ductwork 44 is conveyed through the duct 24, to which reference has previously been had herein, to the windbox 20 of the firing system 18. The air which enters the air preheater 14 is supplied thereto in known fashion from an air supply means (not shown in FIG. 1 in the interest of maintaining clarity of illustration therein).

A description will next be had herein of the mode of operation of the fossil fuel-fired power generation system 10, which is illustrated in FIG. 1 of the drawing. In accordance with the mode of operation of the fossil fuel-fired power generation system 10 of FIG. 1, fossil fuel and air are injected through the compartments 22 of the windbox 20 into the burner region 16 of the fossil fuel-fired steam generator 12 whereat combustion of the fossil fuel and air is initiated in a manner well-known to those skilled in this art. As has been noted herein previously, the hot gases that are produced as a result of this combustion of the fossil fuel and air within the burner region 16 of the fossil fuel-fired steam generator 12 thereafter rise upwardly within the fossil fuel-fired steam generator 12 and in doing so flow to and through the horizontal pass 26 of the fossil fuel-fired steam generator 12, and then flow from the horizontal pass 26 to the rear gas pass 28 of the fossil fuel-fired steam generator 12.

In the course of traversing the rear gas pass 28 of the fossil fuel-fired steam generator 12, the hot gases give up heat to the fluid flowing through the tubes, which collectively comprise the superheater 30. After flowing past the superheater 30, the hot gases are selectively guided by the vane damper assembly 38 immediately to the air preheater 14 or ultimately to the air preheater 14 initially via the SCR 40.

The guiding of hot gases to the SCR 40 is performed so as to ensure that the temperature of the gas leaving the air preheater 14 remains at a level desirable relative to the acid dewpoint temperature in order to thereby minimize corrosion from occurring at the gas exit end 42 of the air preheater 14. To this end, a bypass duct 48 extends between the rear gas pass 28 and a location on the duct work 36 which is intermediate the vane damper assembly 38 and the SCR 40.

Figure 2:
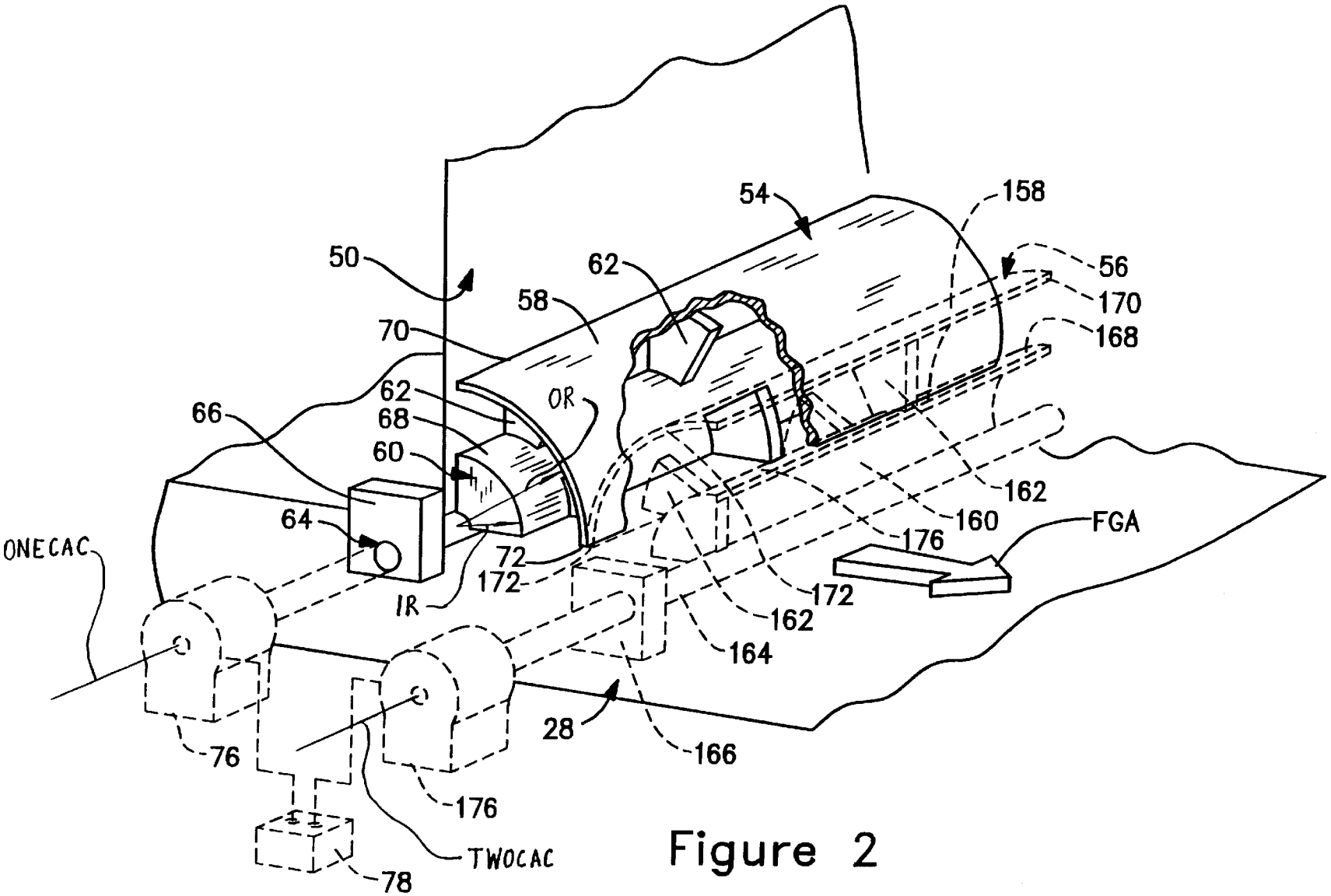
FIG. 2 is an enlarged perspective view, in partial vertical section, of a portion of the one embodiment of the damper vane assembly of the present invention shown in FIG. 1 and showing the damper vane assembly in its dual blocking disposition.
Figure 3:
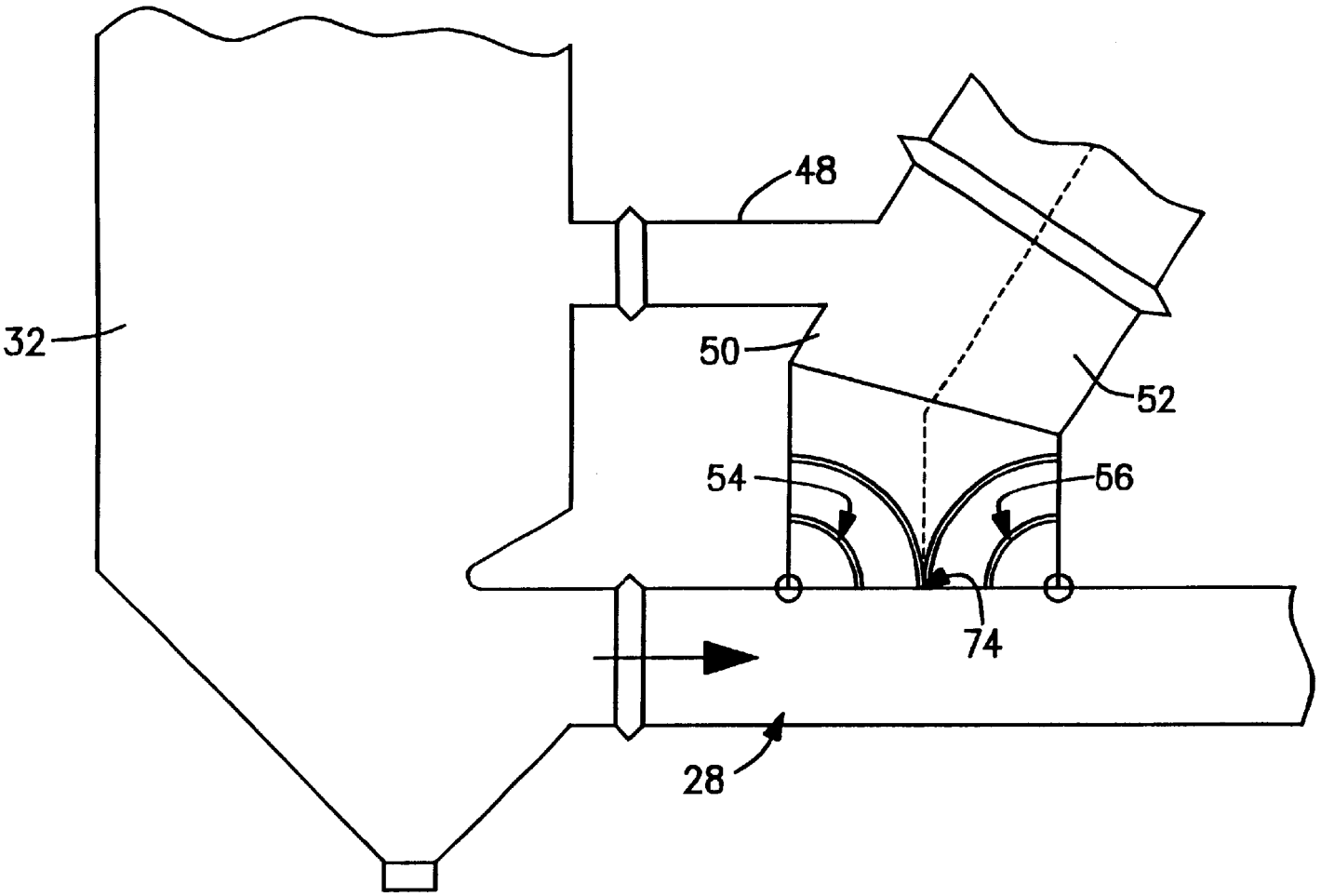
FIG. 3 is an enlarged front schematic view of a portion of the fossil fuel-fired power generation system shown in FIG. 1 and showing the damper vane assembly in its dual blocking disposition as shown in FIG. 2.

Reference is now had to FIG. 2 which is an enlarged perspective view, and FIG. 3, which is a front elevational view, of the damper vane assembly 38 in its dual flow guiding disposition. The damper vane assembly 38 is operable for controlling the flow of flue gas between a flue gas outlet (the rear gas pass 28) of a combustion vessel which generates flue gas (the steam generator 12) and a selective catalytic reactor 40 operable to catalytically treat flue gas. As seen in FIG. 3, the Branch ductwork 36 includes an inlet passage 50 for passage therethrough of flue gas which has been guided thereinto by the damper vane assembly 38 to the SCR 40 and an outlet passage 52 for passage therethrough of flue gas which has exited the SCR 40 following catalytic treatment thereat. The inlet passage 50 and the outlet passage 52 are separated from one another by a duct division wall 53. As seen in FIG. 2, the damper vane assembly includes a first turning vane 54 having a curved extent and a second turning vane 56 having a curved extent (the second turning vane is shown in broken lines for clarity of the drawing).

The first turning vane 54 is disposed relative to the inlet passage 50 of the branch ductwork 36 and the rear gas pass 28 for selective pivotal movement interiorly of these ducts in a manner which will be described in more detail shortly. The second turning vane 56 is disposed relative to the outlet passage 52 of the branch ductwork 36 and to the rear gas pass 28 for selective pivotal movement interiorly of these ducts in a manner which will be described in more detail shortly.

The first turning vane 54 includes an outer radius guide portion 58, an inner radius guide portion 60, and a plurality of mounting arms 62 for mounting the outer radius guide portion 58 to the inner radius guide portion 60. Both the inner radius guide portion 60 and the outer radius guide portion 58 have a longitudinal extent, parallel to their common axis of curvature ONECAC, which is selected in correspondence with the width extent of the inlet passage 52 such that the first turning vane 54 interacts in a sealing manner with the inlet passage 50 to either block the flow of flue gas into the inlet passage, in a flow blocking position of the turning vane, or to guide flue gas into the inlet passage, in a flow guiding position of the turning vane. The inner radius guide portion 60 includes a pair of pivot axles 64 (only one of which is shown) and each pivot axle is rotatably mounted in a respective one of a pair of fulcrums 66 integrally formed with or mounted to a wall portion of the inlet passage 50. The inner radius guide portion 60 includes a curved extent 68 having a predetermined radius of curvature at an inner radius IR from the common axis of curvature ONECAC. The outer radius guide portion 58 has a curved extent having the same predetermined radius of curvature as the curved extent 68 of the inner radius guide portion 60 but at an outer radius OR which is greater than the inner radius IR such that an arcuate opening is formed between the curved extent 68 of the inner radius guide portion 60 and the curved extent of the outer radius guide portion 58. Each of the mounting arms 62 has one end fixedly mounted to the inner radius guide portion 60 and the mounting arm extends radially from the inner radius guide portion 60. The other end of each mounting arm 62 is fixedly mounted to the outer radius guide portion 58 such that the mounting arms 62 fixedly secure the outer radius guide portion 58 to the inner radius guide portion 60 for pivotal movement of the outer radius guide portion 58 and the inner radius guide portion 60 as a single unit. The first turning vane 54 has a first longitudinal edge 70 forming one angular limit of the curved extent of the outer radius guide portion 58 and a second longitudinal edge 72 forming the other angular limit of the curved extent 68 of its inner radius guide portion 60.

The second turning vane 56 includes an outer radius guide portion 158, an inner radius guide portion 160, and a plurality of mounting arms 162 for mounting the outer radius guide portion 158 to the inner radius guide portion 160. Both the inner radius guide portion 160 and the outer radius guide portion 158 have a longitudinal extent, parallel to their common axis of curvature TWOCAC, which is selected in correspondence with the width extent of the outlet passage 52 such that the second turning vane 56 interacts in a sealing manner with the outlet passage 52 to either block the flow of flue gas into the inlet passage, in a flow blocking position of the turning vane, or to guide flue gas into the inlet passage, in a flow guiding position of the turning vane. The inner radius guide portion 160 includes a pair of pivot axles 164 (only one of which is shown) and each pivot axle is rotatably mounted in a respective one of a pair of fulcrums 166 integrally formed with or mounted to a wall portion of the outlet passage 52. The inner radius guide portion 160 includes a curved extent 168 having a predetermined radius of curvature at the inner radius IR from the common axis of curvature TWOCAC. The outer radius guide portion 158 has a curved extent having the same predetermined radius of curvature as the curved extent 168 of the inner radius guide portion 160 but at the outer radius OR which is greater than the inner radius IR such that an arcuate opening is formed between the curved extent 168 of the inner radius guide portion 160 and the curved extent of the outer radius guide portion 158. Each of the mounting arms 162 has one end fixedly mounted to the inner radius guide portion 160 and the mounting arm extends radially from the inner radius guide portion 160. The other end of each mounting arm 162 is fixedly mounted to the outer radius guide portion 158 such that the mounting arms 162 fixedly secure the outer radius guide portion 158 to the inner radius guide portion 160 for pivotal movement of the outer radius guide portion 158 and the inner radius guide portion 160 as a single unit. The second turning vane 56 has a first longitudinal edge 170 forming one angular limit of the curved extent of the outer radius guide portion 158 and a second longitudinal edge 172 forming the other angular limit of the curved extent 168 of its inner radius guide portion 160.

As seen in particular in FIG. 3, the first turning vane 54 is mounted to the inlet passage 50 of the branch ductwork 36 for selective pivoting movement about its common axis of curvature ONECAC and the second turning vane 56 is mounted to the outlet passage 52 of the branch ductwork 36 for selective pivoting movement about its common axis of curvature TWOCAC. In the dual blocking disposition of the damper vane assembly 38 shown in FIGS. 2 and 3, the first turning vane 54 is disposed within the inlet passage 50 such that its first longitudinal edge 70 is in sealing engagement with a wall portion of the inlet passage 50, the second turning vane 56 is disposed within the outlet passage 52 such that its first longitudinal edge 170 is in sealing engagement with a wall portion of the outlet passage 52, and the second longitudinal edge 72 of the first turning vane 54 and the second longitudinal edge 172 of the second turning vane 56 are sealingly engaged with an air pocket seal 74 located at the junction of the open ends of the inlet passage 50, the outlet passage 52 and the rear gas pass 28. The air pocket seal 74 may be configured, for example, as a conventional air pocket seal formed of a pair of longitudinally extending flanges forming a nip therebetween through which the respective second longitudinal edge 72, 172 is inserted in a sealing manner. Thus, it can be seen that, in the dual blocking disposition of the damper vane assembly 38 shown in FIGS. 2 and 3, flue gas flowing in the rear gas pass 28 cannot enter the branch ductwork 36 either through its inlet passage 50 or its outlet passage 52 as the outer radius guide portion 58 of the first turning vane 54 is sealingly engaged around its periphery with the inlet passage 50 to thereby prevent flow into the inlet passage and the outer radius guide portion 158 of the second turning vane 5 is sealingly engaged around its periphery with the outlet passage 52 to thereby prevent flow into the outlet passage. The flue gas flowing in the rear gas pass 28 (schematically shown by the flow arrow FGA in FIG. 2) thus bypasses the SCR 40 so as to not receive the catalytic treatment provided thereby and flows to the air preheater 14 for the heat exchange operation thereat with the incoming air.

The cumulative sealing engagements of the first turning vane 54, respectively, with the rear gas pass 28 and the inlet passage 50, and the second turning vane 56 with the rear gas pass 28 and the outlet passage 52, are preferably zero leakage engagements.

As seen in FIG. 2, a drive motor 76 is operatively coupled to the first turning vane 54 to effect pivoting of the turning vane about its common axis of curvature ONECAC and a drive motor 176 is operatively coupled to the second turning vane 56 to effect pivoting of the turning vane about its common axis of curvature TWOCAC. The drive motors 76, 176 are each connected to a programmable control unit 78, which may be a PC (personal computer) or other computer, for controlled operation of the drive motors.

Thus, it can be seen that the first turning vane 54 is mounted relative to the rear gas pass 28 and the inlet passage 50 and is dimensioned relative to the rear gas pass 28 and the inlet passage 50 such that, in the blocking position of the first turning vane 54, the first longitudinal edge 70 and the second longitudinal edge 72—which together comprise a pair of opposed edges of the first turning vane—are in substantially sealing engagement with a surface of the inlet passage 50 to substantially block the flow of flue gas therepast. Additionally, the first turning vane 54 is mounted relative to the rear gas pass 28 and the inlet passage 50 and is dimensioned relative to the rear gas pass 28 and the inlet passage 50 such that, in the flow guiding position of the first turning vane, the one opposed edge—namely, the second longitudinal edge 72—is in substantially sealing engagement with a surface of the rear gas pass 28 and the other opposed edge—namely, the first longitudinal edge 70—is in substantially sealing engagement with the inlet passage 50 so as guide flue gas from the rear gas pass 28 into the inlet passage 50. Moreover, it can be seen that the second turning vane 56 is mounted relative to the rear gas pass 28 and the outlet passage 52 and is dimensioned relative to the rear gas pass 28 and the outlet passage 52 such that, in the blocking position of the second turning vane 56, the first longitudinal edge 170 and the second longitudinal edge 172—which together comprise a pair of opposed edges of the second turning vane 56—are in substantially sealing engagement with the outlet passage 52 to substantially block the flow of flue gas therepast. Also, the second turning vane 56 is mounted relative to the rear gas pass 28 and the outlet passage 52 and is dimensioned relative to the rear gas pass 28 and the outlet passage 52 such that, and, in the flow guiding position of the second turning vane 56, the one opposed edge—namely, the second longitudinal edge 172—is in substantially sealing engagement with a surface of the rear gas pass 28 and the other opposed edge—namely, the first longitudinal edge 170—is in substantially sealing engagement with the outlet passage 52 so as guide flue gas from the outlet passage 52 into the rear gas pass 28. The curved extents of the first turning vane 54 and the second turning vane 56 advantageously create a low draft loss by promoting the transitional flow of flue gas from its flow direction along the rear gas pass 28 to the inlet passage 50 or, respectively, from the outlet passage 52 to the rear gas pass 28.

Figure 4:
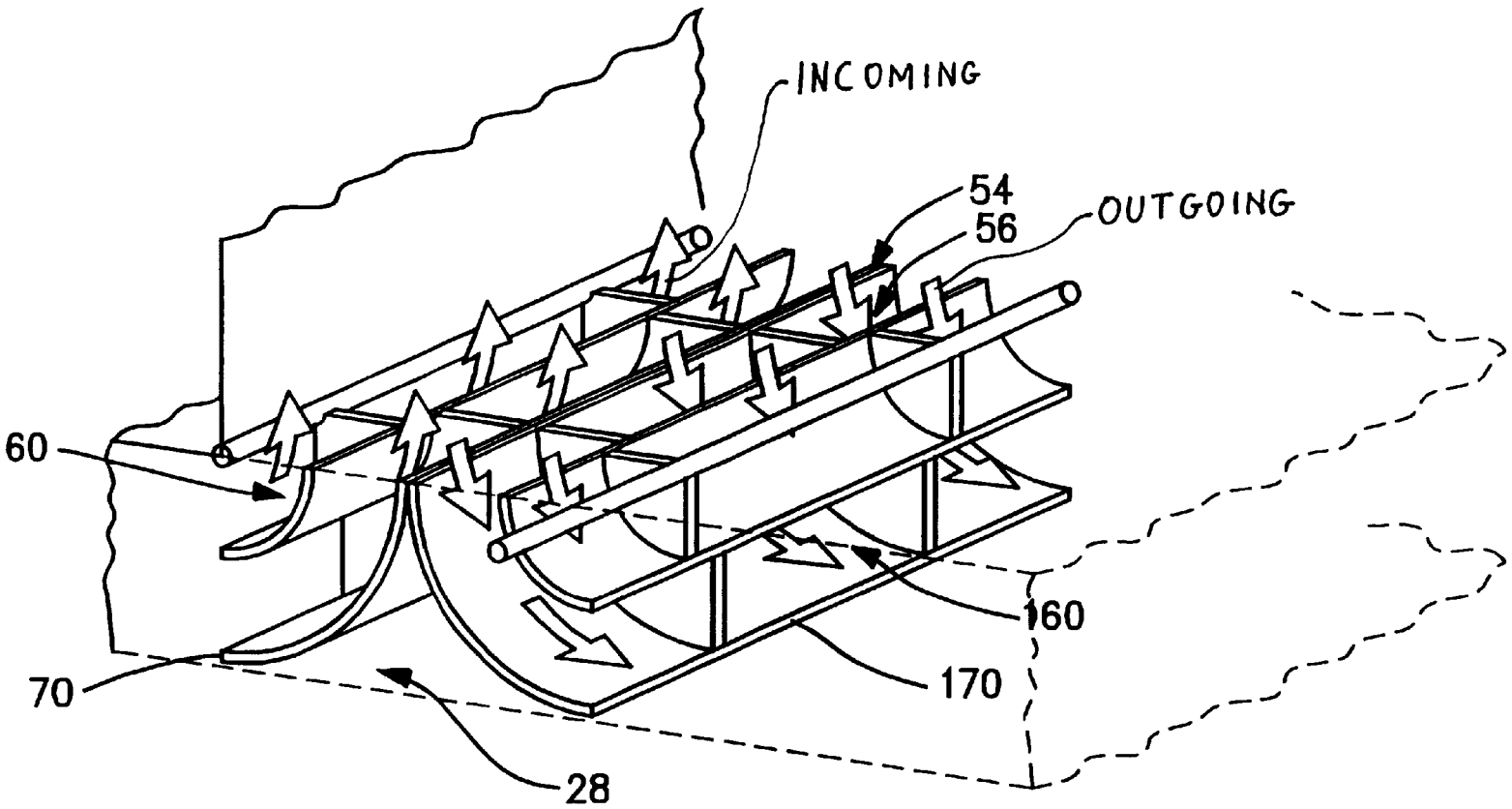
FIG. 4 is an enlarged perspective view, in partial vertical section, of a portion of the one embodiment of the damper vane assembly of the present invention shown in FIG. 1 and showing the damper vane assembly in its dual flow guiding disposition.
Figure 5:
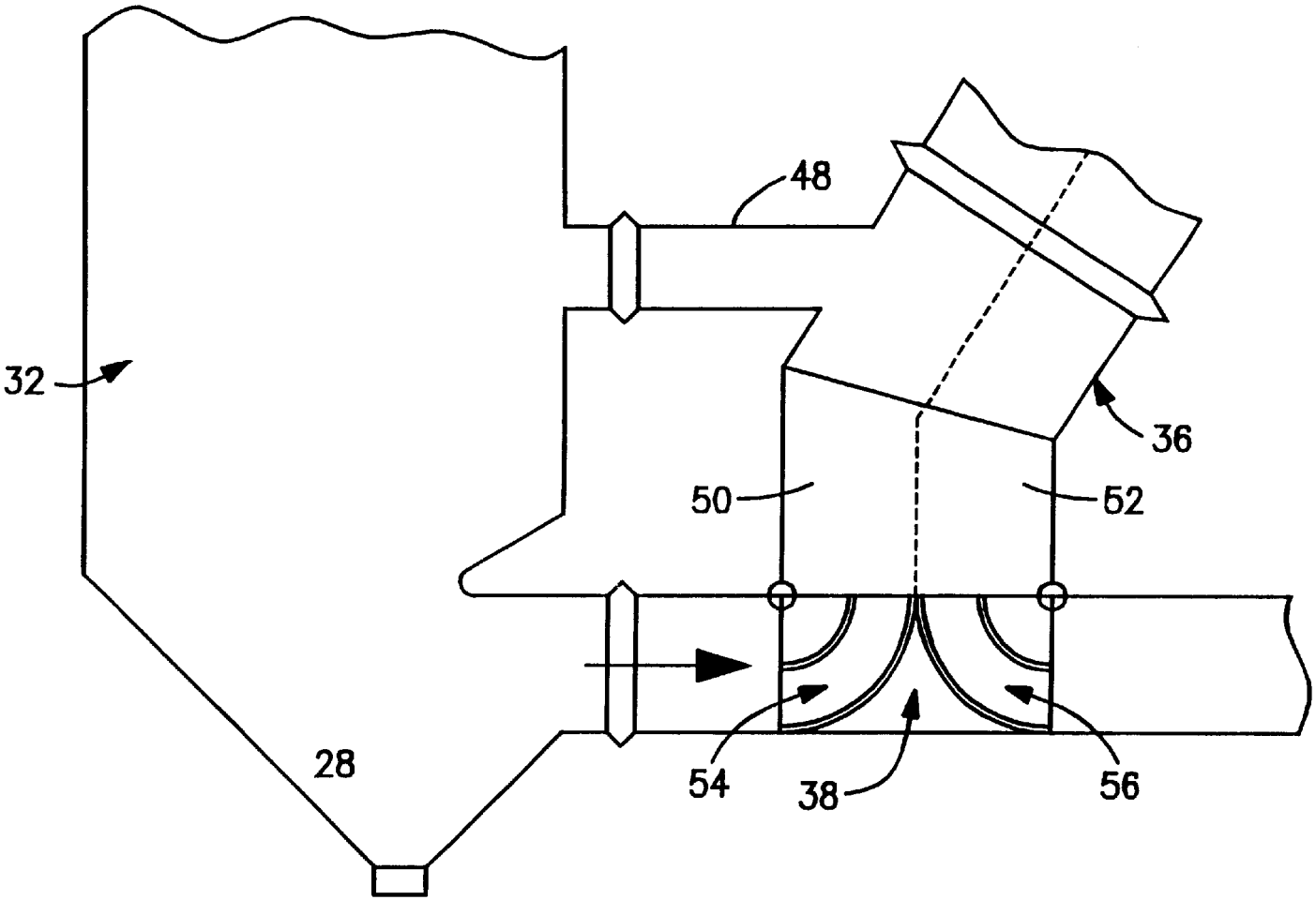
FIG. 5 is an enlarged front schematic view of a portion of the fossil fuel-fired power generation system shown in FIG. 1 and showing the damper vane assembly in its dual flow guiding disposition as shown in FIG. 4.

Reference is now had to FIG. 4, which is an enlarged perspective view, and FIG. 5, which is a front elevational view, of the damper vane assembly 38 in its dual flow guiding disposition in which the damper vane assembly is operable to guide flue gas from the rear gas pass 28 into the SCR 40 (via the branch ductwork 36) and to guide flue gas which has exited the SCR 40 after catalytic treatment thereat to the rear gas pass 28. In the event that the damper vane assembly 38 is in its dual blocking disposition as shown in FIGS. 2 and 3 immediately prior to its movement into its dual flow guiding disposition as shown in FIGS. 4 and 5, the first turning vane 54 and the second turning vane 56 are moved as follows to accomplish this movement between the two dispositions. The first turning vane 54 is pivoted about its common axis of curvature ONECAC in a clockwise direction from its disposition shown in FIGS. 2 and 3 in which the first longitudinal edge 70 is in sealing engagement with a wall portion of the inlet passage 50 into the disposition shown in FIGS. 4 and 5 in which the first longitudinal edge 70 is in at least a substantially sealed engagement with a floor portion of the rear gas pass 28. The second turning vane 56 is pivoted about its common axis of curvature TWOCAC in a counter-clockwise direction from its disposition shown in FIGS. 2 and 3 in which the first longitudinal edge 170 is in sealing engagement with a wall portion of the outlet passage 52 into the disposition shown in FIGS. 4 and 5 in which the first longitudinal edge 170 is in at least a substantially sealed engagement with a floor portion of the rear gas pass 28. In these respective dispositions, the first turning vane 54 guides flue gas (as schematically shown in FIG. 4 by the arrow INCOMING) from the rear gas pass 28 into the inlet passage 50 of the Branch ductwork 36 for introduction of the flue gas into the SCR 40 and the second turning vane 56 guides flue gas exiting the SCR 40 (as schematically shown in FIG. 4 by the arrow OUTGOING) into the rear gas pass 28 for further flow therealong to the air preheater 14. Thus, all or substantially all of the flue gas flowing in the rear gas pass 28 is guided to the SCR 40 for catalytic treatment thereat and is thereafter guided to the air preheater 14. The control unit 78 can be programmed to control the drive motors 76, 176 to pivot the respective turning vanes 54, 56 from their blocking dispositions shown in FIGS. 2 and 3 into their flow guiding dispositions shown in FIGS. 4 and 5.

In the event that the damper vane assembly 38 is in its dual flow guiding disposition as shown in FIGS. 4 and 5 immediately prior to its movement into its dual blocking disposition as shown in FIGS. 2 and 3, the first turning vane 54 and the second turning vane 56 are moved as follows to accomplish this movement between the two dispositions. The first turning vane 54 is pivoted about its common axis of curvature ONECAC in a counter-clockwise direction from its disposition shown in FIGS. 4 and 5 in which the first longitudinal edge 70 is in at least a substantially sealed engagement with a floor portion of the rear gas pass 28 into its disposition shown in FIGS. 2 and 3 in which the first longitudinal edge 70 is in sealing engagement with a wall portion of the inlet passage 50 into the disposition. The second turning vane 56 is pivoted about its common axis of curvature TWOCAC in a clockwise direction from its disposition shown in FIGS. 4 and 5 in which the first longitudinal edge 170 is in at least a substantially sealed engagement with a floor portion of the rear gas pass 28 into its disposition shown in FIGS. 2 and 3 in which the first longitudinal edge 170 is in sealing engagement with a wall portion of the outlet passage 52. The control unit 78 can be programmed to control the drive motors 76, 176 to pivot the respective turning vanes 54, 56 from their flow guiding dispositions shown in FIGS. 4 and 5 into their blocking dispositions shown in FIGS. 2 and 3.

Figure 6:
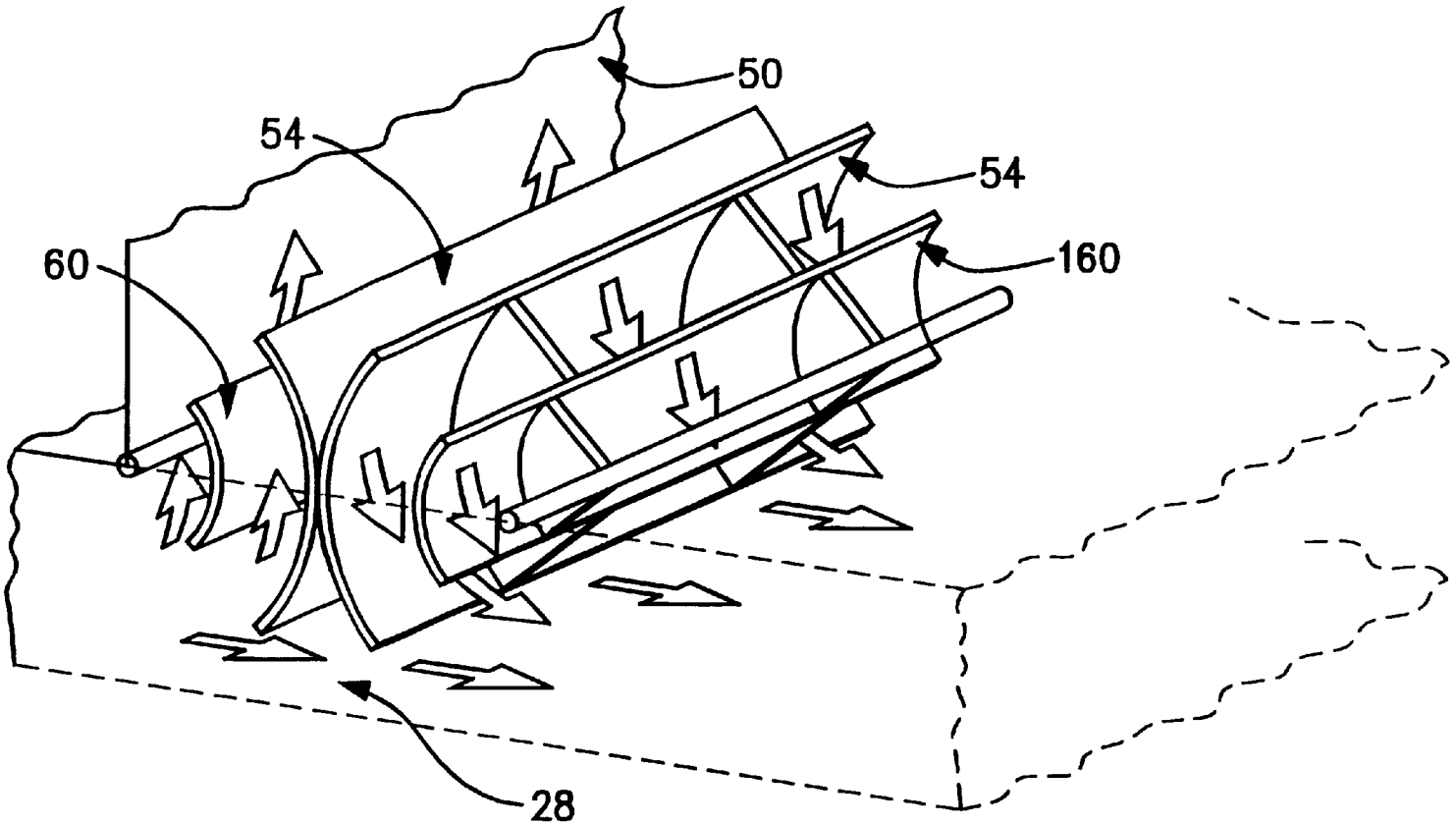
FIG. 6 is an enlarged perspective view, in partial vertical section, of a portion of the one embodiment of the damper vane assembly of the present invention shown in FIG. 1 and showing the damper vane assembly in its reduced flow guiding disposition.

Reference is now had to FIG. 6 which is an enlarged perspective view of the damper vane assembly 38 in its reduced flow guiding disposition in which it guides some, but not all, of the flue gas flowing in the rear gas pass 28 to the SCR 40. In this configuration of the damper vane assembly, the first turning vane 54 has been pivoted to a location in which the outer radius guiding portion 58 is partially in the inlet passage 50 of the branch ductwork 36 and partially in the rear gas pass 28. Also, the second turning vane 56 has been pivoted to a location in which the outer radius guiding portion 158 is partially in the outlet passage 52 of the branch ductwork 36 and partially in the rear gas pass 28. A portion of the flue gas flowing in the rear gas pass 28 is guided by the first turning vane 54 into the inlet passage 50 while, at the same time, flue gas flowing in rear gas pass 28 is not diverted or guided by the first turning vane 54 but, instead, flows downstream of the damper vane assembly 38 without having been catalytically treated by the SCR 40.

Figure 7:
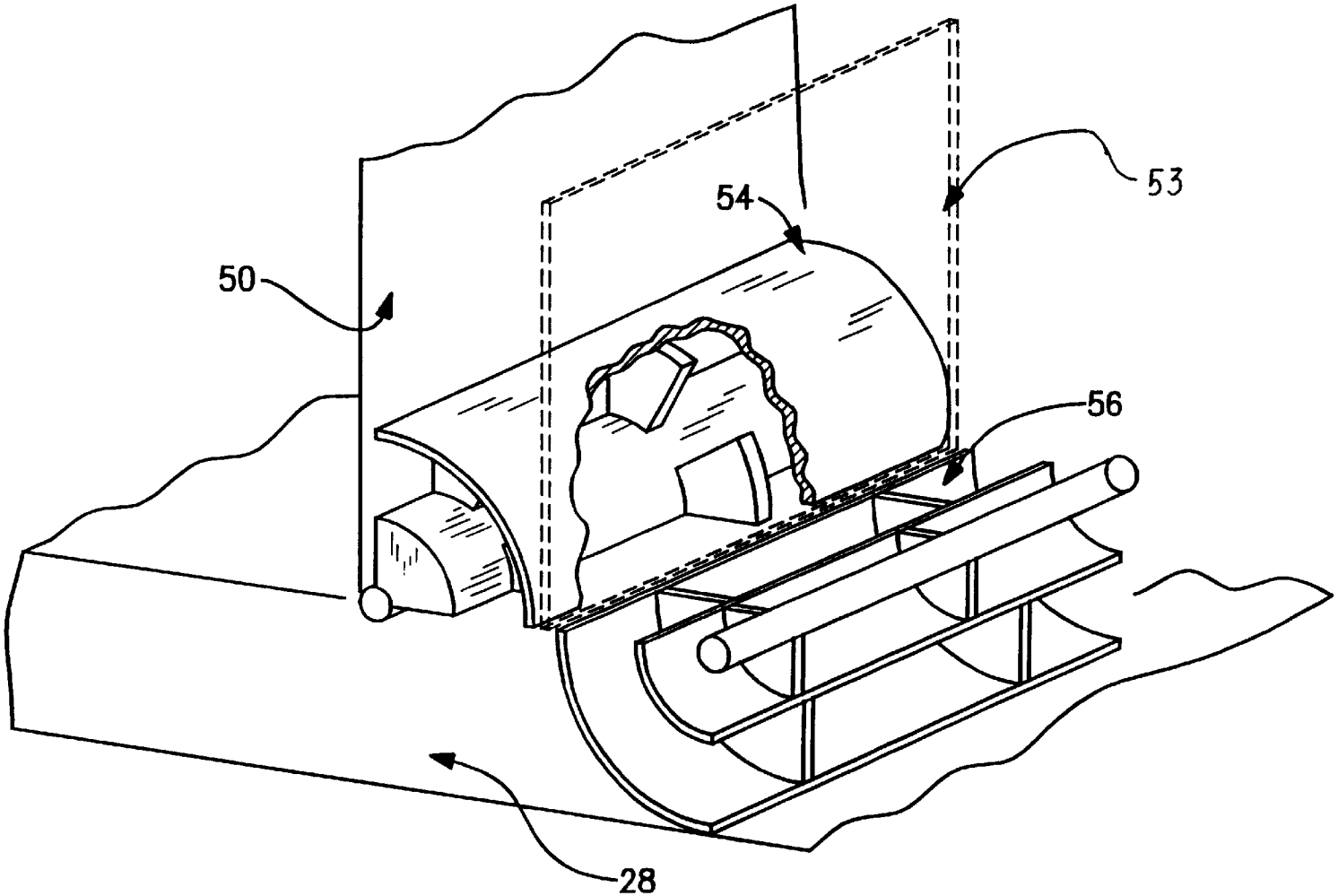
FIG. 7 is an enlarged perspective view, in partial vertical section, of a portion of the one embodiment of the damper vane assembly of the present invention shown in FIG. 1 and showing the damper vane assembly in its bypass assist disposition.

Reference is now had to FIG. 7 which is an enlarged perspective view of the damper vane assembly 38 in its bypass assist disposition in which it (1) blocks the flow of the flue gas from the rear gas pass 28 to the SCR 40 in conjunction with an open condition of the bypass duct 48, thereby creating a backpressure which promotes the flow of flue gas into the bypass duct 48 to the SCR 40, and (2) permits the exit flow of flue gas exiting the SCR 40 to the rear gas pass 28. This disposition of the damper vane assembly 38 may be useful during a less than full load—i.e., low load—condition of the steam generator 12 when it is desired to divert flue gas before or during passage through the economizer 30 to the SCR 40. In this configuration of the damper vane assembly, the first turning vane 54 has been pivoted to a location in which the outer radius guiding portion 58 is fully in the inlet passage 50 of the Branch ductwork 36. Also, the second turning vane 56 has been pivoted to a location in which the outer radius guiding portion 158 is located fully in the rear gas pass 28. The flue gas flowing in the rear gas pass 28 is blocked by the first turning vane 54 from entering the inlet passage 50 of the branch ductwork 36 while, at the same time, the disposition of the second turning vane 56 in the rear gas pass 28 acts to block the flow of flue gas therebeyond, whereupon a backpressure is created into the economizer 30 which promotes the flow of flue gas into and through the bypass duct 48 to the SCR 40. Flue gas which has been catalytically treated by the SCR 40 exits through the outlet passage 52 and then flows into the rear gas pass 28 downstream of the damper vane assembly 38.

While an embodiment and variations of the present invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

I claim:

1. A damper vane assembly for controlling the flow of flue gas between a flue gas pass of a combustion vessel which generates flue gas and a selective catalytic reactor operable to catalytically treat flue gas in a combustion system, comprising:

a first turning vane having a curved extent, the first turning vane being moveable between a blocking position in which it blocks communication between the combustion vessel and the selective catalytic reactor and a flow guiding position in which the curved extent of the first turning vane guides flue gas from the flue outlet to the selective catalytic reactor; and a second turning vane having a curved extent, the second turning vane being moveable between a blocking position in which it blocks communication between the selective catalytic reactor and the flue gas outlet and a flow guiding position in which the curved extent of the second turning vane guides flue gas from the selective catalytic reactor to the flue gas outlet.

2. A damper vane assembly according to claim 1 wherein the first turning vane and the second turning vane are pivotally mounted for pivoting movement between their respective blocking and flow guiding positions.

3. A damper vane assembly according to claim 1 wherein the combustion system includes an inlet passage communicated with the flue gas pass and the selective catalytic reactor for the flow of flue gas therethrough to the selective catalytic reactor and an outlet passage separate from the inlet passage and communicated with the flue gas pass and the selective catalytic reactor for the passage therethrough of flue gas exiting the selective catalytic reactor, the first turning vane includes a pair of opposed edges, the second turning vane includes a pair of opposed edges, the first turning vane is mounted relative to the flue gas pass and the inlet passage and is dimensioned relative to the flue gas pass and the inlet passage such that, in the blocking position of the first turning vane, the pair of opposed edges of the first turning vane are in substantially sealing engagement with a surface of the inlet passage to substantially block the flow of flue gas therepast and, in the flow guiding position of the first turning vane, the one opposed edge is in substantially sealing engagement with a surface of the flue gas pass and the other opposed edge is in substantially sealing engagement with the inlet passage so as guide flue gas from the flue gas pass into the inlet passage, and the second turning vane is mounted relative to the flue gas pass and the outlet passage and is dimensioned relative to the flue gas pass and the outlet passage such that, in the blocking position of the second turning vane, the pair of opposed edges of the second turning vane are in substantially sealing engagement with the outlet passage to substantially block the flow of flue gas therepast and, in the flow guiding position of the second turning vane, the one opposed edge is in substantially sealing engagement with a surface of the flue gas pass and the other opposed edge is in substantially sealing engagement with the outlet passage so as guide flue gas from the outlet passage into the flue gas pass.

* * * * *